US006554642B1

(12) United States Patent
Xiang et al.

(10) Patent No.: US 6,554,642 B1
(45) Date of Patent: Apr. 29, 2003

(54) ELECTRICAL CONNECTOR

(75) Inventors: Xinghai Xiang, Kunsan (CN); Shiyou Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/002,891

(22) Filed: Dec. 5, 2001

(51) Int. Cl.[7] ..... H01R 13/60
(52) U.S. Cl. ..... 439/567; 439/607; 439/79
(58) Field of Search ..... 439/567, 607–610, 439/573, 571, 572, 570, 79

(56) References Cited

U.S. PATENT DOCUMENTS 6,066,002 A * 5/2000 Sterckx et al. ..... 439/607
6,086,418 A * 7/2000 Chang ..... 439/567
6,165,015 A * 12/2000 Wu et al. ..... 439/607
6,099,351 A1 * 2/2001 Wu ..... 439/607
6,186,830 B1 * 2/2001 Lin et al. ..... 439/607
6,257,924 B1 * 7/2001 Lund et al. ..... 439/607

* cited by examiner

*Primary Examiner*—Hien Vu
(74) *Attorney, Agent, or Firm*—Wei Te Chung

(57) ABSTRACT

An electrical connector includes an insulative housing having front and rear faces and top and bottom faces connecting the front and rear faces. A front shielding member includes a base plate attached to the front face of the housing and has a top flange partly overlapping the top face of the housing and covering recesses defined in the top face of the housing. The top face defines recesses exposed to the rear face thereby forming channels between the housing and the top flange. A rear conductive cover is attached to the rear face. The rear cover forms a plurality of lugs having U-shaped free ends forcibly fit into and resiliently engaging the top flange thereby fixing the rear cover in position and establishing electrical connection therebetween.

5 Claims, 4 Drawing Sheets

ELECTRICAL CONNECTOR

BACKGROUND OF THE INVENTION

1. Field of the Invention

The present invention generally relates to an electrical connector, such as a DVI (Digital Visual Interface) connector and in particular to a completely shielded electrical connector.

2. The Related Arts

Electrical connectors are widely used to connect separate electrical devices. Electrical signals are transmitted between the electrical devices via the electrical connectors. In high frequency applications, EMI (Electro-Magnetic Interference) is one of the major causes for noise. Suppression of EMI has been widely studied. Inventions addressing the EMI issue are widely known, such as Taiwan Patent Application Nos. 84207642 and 86212787 disclosing electrical connectors comprising an insulative housing retaining a number of conductive pins therein. The conductive pins has front and rear sections extending beyond front and rear faces of the housing. A shielding member is attached to the housing for surrounding and shielding the front sections of the pins. However, the rear sections of the pins are not covered and shielded. Disadvantages are that (1) the rear sections of the pins may be damaged by being hit or impacted by foreign objects, such as user's fingers, (2) short-circuiting may happen when the foreign objects are conductive, (3) debris and dusts may get into the connector via spacing between the uncovered pins, and (4) the uncovered rear sections of the pins are readily subject to undesired electromagnetic interference, resulting in poor transmission of signals.

Taiwan Patent Publication No. 82111200 discloses an electrical connector which comprises, besides the shielding member, a secondary rear shielding cover which is attached to the rear side of the housing for covering and shielding the rear sections of the pins. However, the rear shielding cove has a complicated structure and may not be securely attached to the connector.

It is thus desirable to provide a completely shielded electrical connector to alleviate the above-discussed problems.

SUMMARY OF THE INVENTION

Accordingly, an object of the present invention is to provide an electrical connector having a rear cover for completely shielding conductive contacts of the connector.

Another object of the present invention is to provide an electrical connector having a cover for preventing entry of debris and dusts into the connector.

A further object of the present invention is to provided an electrical connector having contacts fully covered and protected from impact and physical contact by foreign objects.

To achieve the above objects, in accordance with the present invention, there is provided an electrical connector comprising an insulative housing having front and rear faces and top and bottom faces connecting the front and rear faces. A projection is formed on the front face of the housing with a plurality of passageways defined therein and exposed to the rear face. Conductive contacts are received and retained in the passageways, partly extending beyond the rear face of the housing. A front shielding member comprises a base plate attached to the front face of the housing and a shroud wall formed on the base section and defining an opening fit over the projection and shielding the contacts. The shielding member comprises a top flange partly overlapping the top face of the housing and covering recesses defined in the top face of the housing. The recesses are exposed to the rear face thereby forming channels between the housing and the top flange. A rear conductive cover is attached to the rear face of the housing for covering and shielding the portions of the contacts that extend beyond the rear face of the housing. The rear cover forms a plurality of lugs having U-shaped free ends forcibly fit into and resiliently engaging the top flange thereby fixing the rear cover in position and establishing electrical connection therebetween. The rear cover has opposite side panels fit into slits defined in the rear face of the housing for helping fixing the rear cover.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
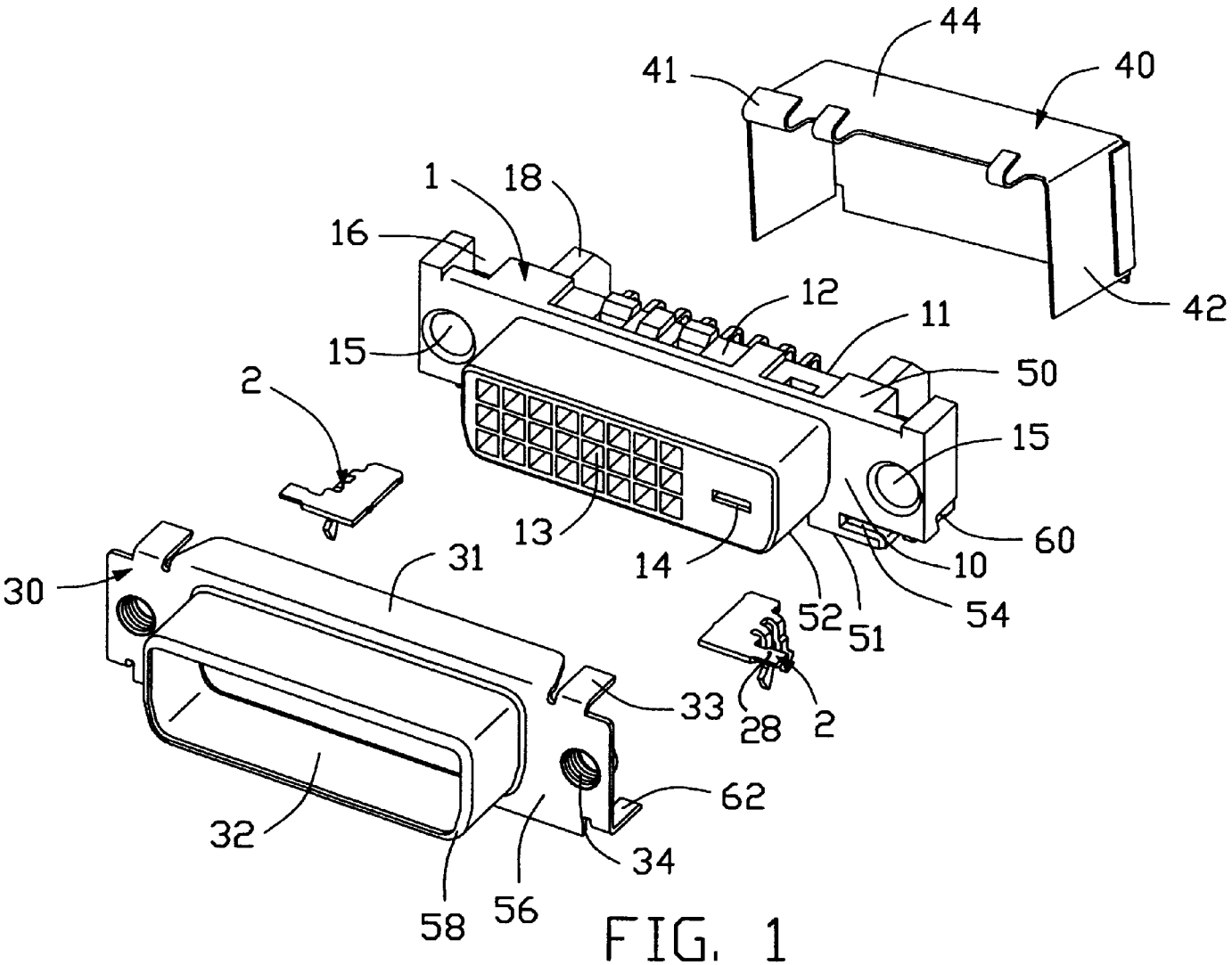
FIG. 1 is an exploded view of an electrical connector constructed in accordance with the present invention.

With reference to the drawings and in particular to FIG. 1, an electrical connector comprises an insulative housing 1 having a front face 10, a rear face 11 and top and bottom faces 50, 51 connecting the front and rear faces 10, 11. A projection 52 extends from the front face 10 with a number of first passageways 13 defined therein and extending to and exposed to the rear face 11 of the housing 1. A second passageway 14 is also defined in the projection 52 and extends to the rear face 11 of the housing 1. In the embodiment illustrated, the first passageways 13 are arranged in three rows.

Two openings 54 are defined in the housing 1 on opposite sides of the projection 52 for receiving and retaining board locks 2 wherein each opening 54 defines horizontal and vertical slits for respectively receiving the horizontal and vertical sections of the corresponding board lock. The board locks 2 help retaining the connector on for example a printed circuit board (not shown).

A front shielding member 30 comprises a base plate 56 attached to the front face 10 of the housing 1 and a shroud wall 58 formed on the base section 56, defining an opening 32 for being fit over the projection 52 whereby the base plate 50 covers the front face 10 of the housing 1 and the shroud wall 58 surrounds the projection 52. A top flange 31 extends from the base plate 56 partially overlapping and covering the top face 50 of the housing 1. A number of recesses 12 are defined in the top face 50 of the housing 1 and exposed to the rear face 11 of the housing 1. The recesses 12 are at least partly covered by the top flange 31 of the front shielding member 30 thereby forming channels between the housing 1 and the top flange 31 of the front shielding member 30.

Two notches 16 are defined in the top face 50 of the housing 1. Two deformable tabs 33 extend from the base plate 56 and are located on opposite sides of the top flange 31 for being bent into and thus engaging with the notches 16 to attach the front shielding member 30 to the housing 1. Similarly, notches 60 are defined in the bottom face 51 of the housing 1 for receiving deformable tabs 62 of the front shielding member 30. The tabs 62 are bent to engage the notches 60 for facilitating attachment of the front shielding member 30 to the housing 1 wherein the tag 28 of the board lock 2 is sandwiched between the tab 62 and the housing 1 for preventing the board lock 2 from moving in a front-to-back direction.

Two bores 15 are defined in the housing 1 for receiving fasteners (not shown). Corresponding holes 34 are defined in the base plate 56 of the front shielding member 30 for partially receiving and engaging the fasteners.

Figure 2:
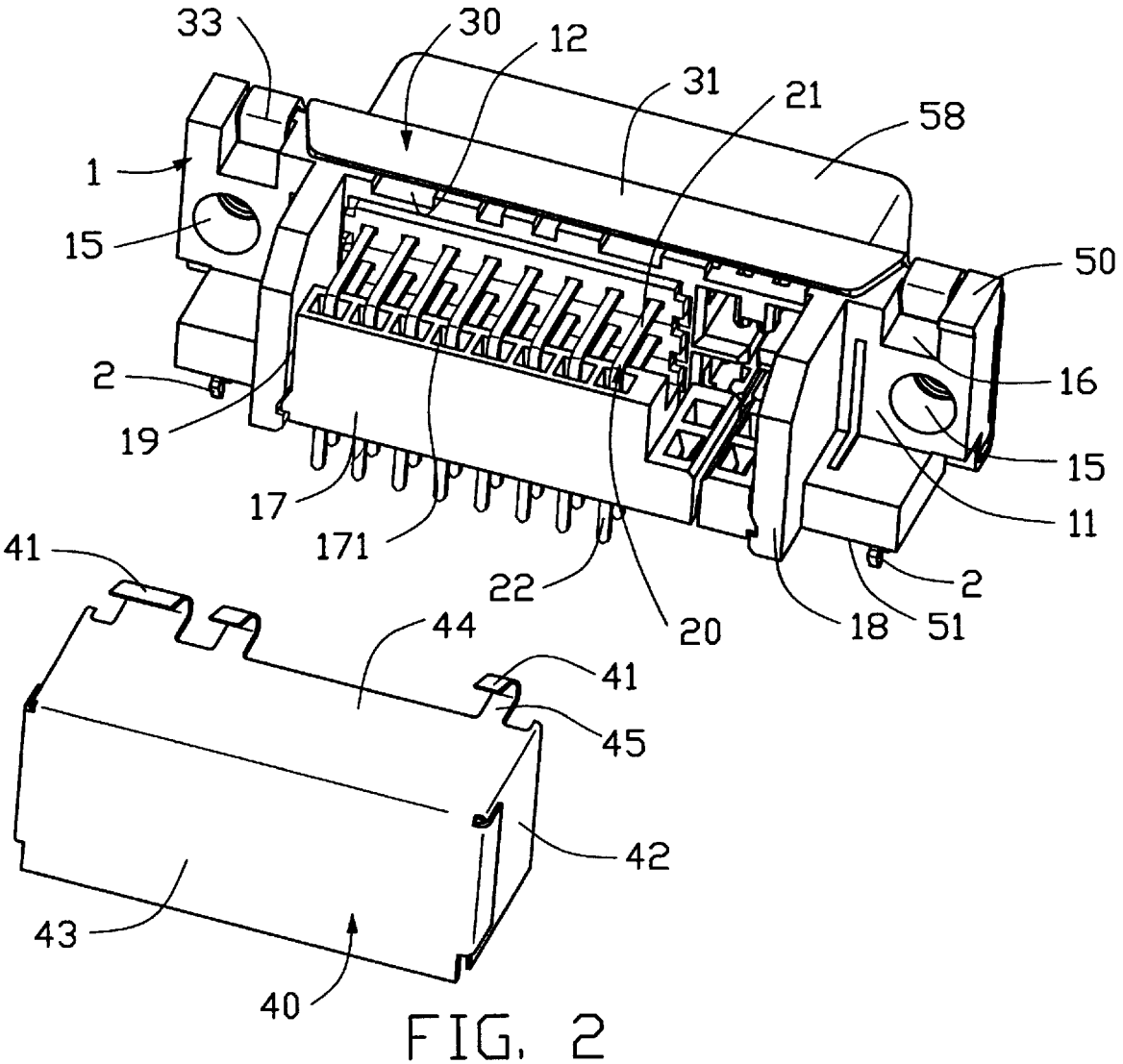
FIG. 2 is a perspective view of the electrical connector of the present invention, observed from the rear side with a rear cover detached therefrom.
Figure 3:
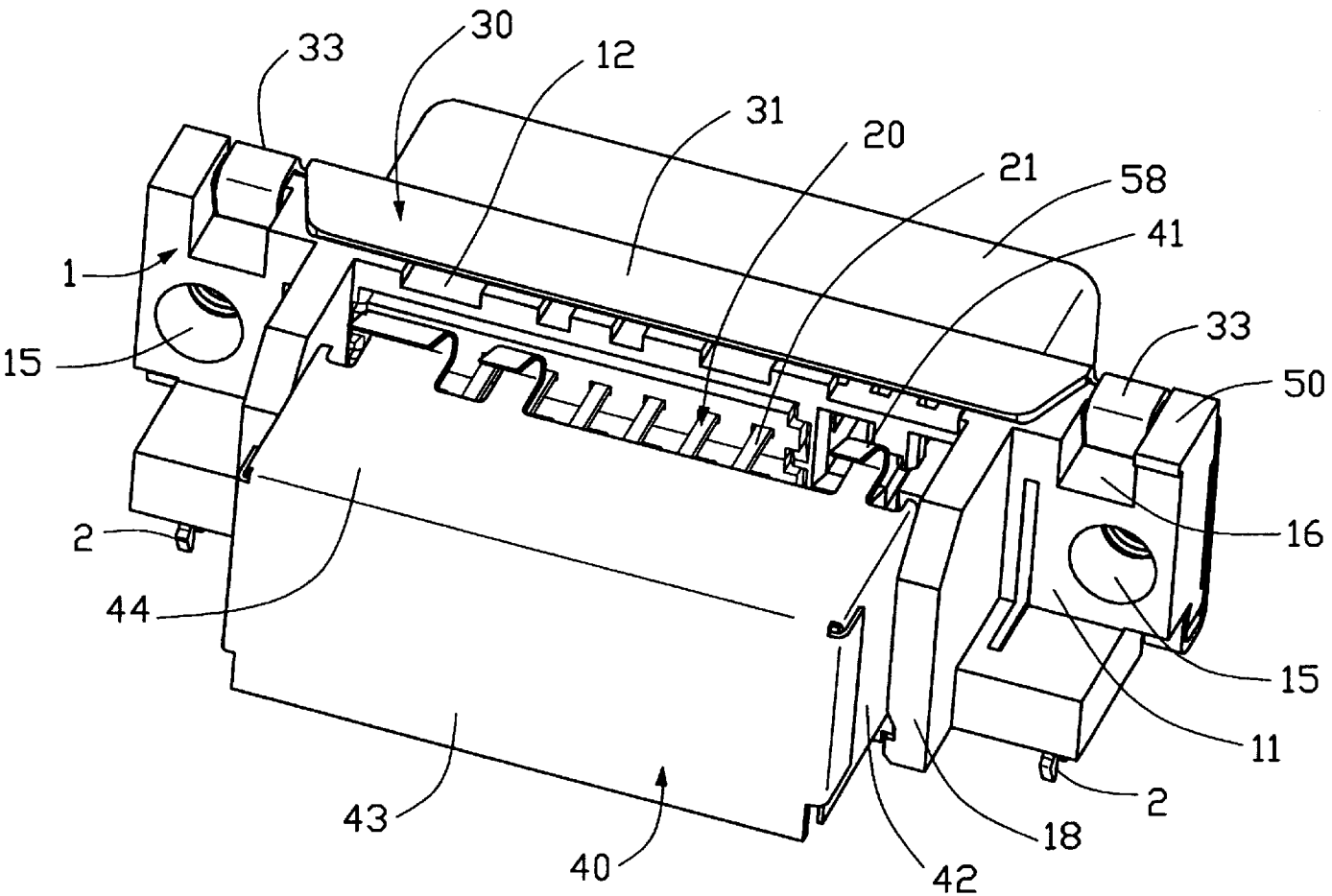
FIG. 3 is similar to FIG. 2 but showing the rear cover to be mounted to the electrical connector of the present invention.
Figure 4:
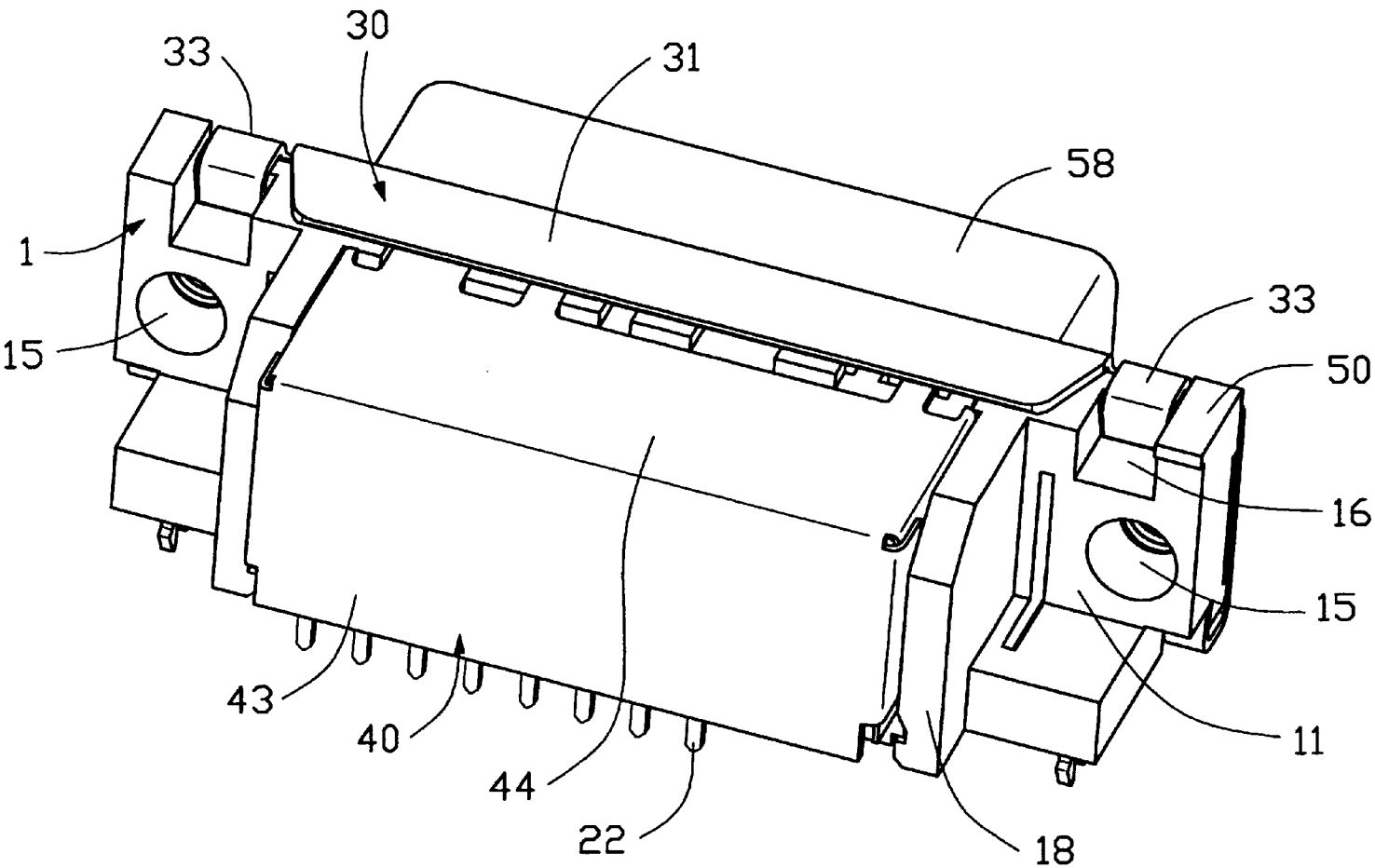
FIG. 4 is a rear side perspective view showing the rear cover mounted to the electrical connector.

Also referring to FIG. 2, two partition walls 18 are formed on the rear face 11 of the housing 1 defining a space therebetween. A spacer 17 is fixed between the partition walls 18. A plurality of third passageways 171 are defined in the spacer 17. A slit 19 is formed between the spacer 17 and each partition wall 18.

A first conductive contact 20 is received in each first passageway 13 and a second conductive contact (not shown) is received in the second passageway 14. The second contact can be a grounding member which engages with a corresponding grounding member of a mating connector (not shown). Each first contact 20 has a mating section 21 partially received and retained in the first passageway 13 with a portion thereof extending beyond the rear face 11 of the housing 1 and a soldering section or tail 22 extending through the corresponding third passageway 171 of the spacer 17. An arc connecting section (not labeled) connects between the mating section 21 and the soldering section 22 whereby the soldering section 22 is substantially perpendicular to or inclined at a predetermined angle with respect to the mating section 21.

A rear cover 40 is attached to the housing 1 for covering and shielding the first conductive contacts 20. The rear cover 40 comprises a back panel 40 and a top panel 44 perpendicularly extending from the back panel 40. A number of lugs 45 extend from the top panel 44 and are received in the recesses 12 of the housing 1. Each lug 45 forms a U-shaped end 41 for being forcibly fit into the corresponding channel defined between the housing 1 and the top flange 31 of the front shielding member 30 that covers the top face 50 of the housing 1 and resiliently engaging the top flange 31 thereby forming electrical engagement between the front shielding member 30 and the rear cover 40 and helping to fix the rear cover 40 in position.

Two side panels 42 extend between the top and back panels 44, 43. The side panels 42 are fit into the slits 19 defined between the spacer 17 and the partition walls 18 for fixing the rear cover 40 to the rear side of the housing 1. If desired, the slits 19 may be made interferentially engaging the side panels 42 of the rear cover 40.

The rear cover 40, so constructed and attached to the rear side of the housing 1, completely covers the portions of the first contacts 20 that are exposed through the space between the partition walls 18 of the housing. The first contacts 20 are thus protected from damage by foreigner objects (not shown). The first contacts 20 are also protected from electromagnetic interference when the rear cover 40 is made of a conductive material and suitably grounded via the electrical engagement between the front shielding member 30 and the rear cover 40.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An electrical connector assembly comprising an insulative housing having front and rear faces connected by top and bottom faces, a plurality of passageways defined in the housing and exposed to both front and rear faces, recesses being defined in the top face and exposed to the rear face;

a plurality of conductive contacts received in corresponding passageways and each having a portion extending beyond the rear face of the housing;

a front metal shielding member attached to the front face of the housing and having a top flange partially overlapping the top face of the housing and covering the recesses thereby forming channels between the housing and the top flange of the front shielding member; and a rear cover, made of conductive material, attached to the rear face of the housing for covering and shielding the portions of the contacts extending beyond the rear face of the housing, the rear cover forming a plurality of lugs each having a free end resiliently pressing against the top flange of the shielding member to fix the rear cover in position and form electrical engagement therebetween; wherein two partition walls are formed on the rear face of the housing for supporting an insulative spacer therebetween, the spacer defining a plurality of though holes, each contact having a tail extending and retained in a corresponding one of the through holes of the spacer; wherein a slit is defined between the spacer and each partition wall and wherein the rear cover comprises two side panels fit into the slits for helping to fix he rear cover in position.

2. The electrical connector as claimed in claim 1, wherein a U-shaped configuration is formed on the free end of each lug of the rear cover for being forcibly fit into the channel and resiliently engaging the top flange of the front shielding member.

3. The electrical connector as claimed in claim 1, wherein a projection is formed on the front face of the housing with the passageways extending through the projection.

4. The electrical connector as claimed in claim 3, wherein the front shielding member comprises a base plate attached to the front face of the housing, a shroud wall formed on the base plate and defining an opening fit over the projection and shielding the contacts.

5. An electrical connector comprising an insulative housing defining opposite front and rear faces, and opposite top and bottom faces, a pair of partition walls formed on the rear face of the housing;

at least one recess being formed in one of the top face an the bottom face with tails exposed outside of the rear face;

a plurality of conductive contacts received in the housing with tails exposed outside of the rear face;

a front metal shielding member attached to the font face of the housing and with a rearwardly extending flange covering said recess, the flange incorporating the recess to form a channel thereof;

a rear metal cover attached to the rear face of the housing shielding said tails of herein, the rear metal cover includes at least one U-shaped lug extending into the channel and resiliently engaged with the flange for both grounding and retention; and an insulative spacer arranged between opposite partition walls of the housing and defining a plurality of through holes for allowing the tails of the contacts extending therethrough, a slit defined between the spacer and each partition wall; wherein the rear cover comprises two side panels fit into the slits for helping to fix the rear cover in position.

* * * * *